US006268578B1

(12) United States Patent
Nakai

(10) Patent No.: US 6,268,578 B1
(45) Date of Patent: Jul. 31, 2001

(54) KEY SWITCH USED IN A KEYBOARD

(75) Inventor: Takashi Nakai, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 09/557,387

(22) Filed: Apr. 25, 2000

(30) Foreign Application Priority Data

Apr. 26, 1999 (JP) ..... 11-118223

(51) Int. Cl.[7] ..... H01H 13/14
(52) U.S. Cl. ..... 200/520; 200/5 A
(58) Field of Search ..... 200/5 A, 341–395, 200/512–517; 400/491.1, 49.2, 491, 495, 496, 495.1

(56) References Cited

U.S. PATENT DOCUMENTS 4,453,063 * 6/1984 Wanatowicz, Jr. et al. ..... 200/340
4,771,146 * 9/1988 Suzuki et al. ..... 200/340
4,902,862 * 2/1990 Oelsch et al. ..... 200/344
5,504,283 * 4/1996 Kako et al. .
5,769,210 * 6/1998 Tsai ..... 200/344
5,823,325 * 10/1998 Lin ..... 200/344
5,994,655 * 11/1999 Tsai ..... 200/344

* cited by examiner

*Primary Examiner*—Lincoln Donovan
*Assistant Examiner*—Nhung Nguyen
(74) *Attorney, Agent, or Firm*—Brinks Hofer Gilson & Lione

(57) ABSTRACT

A key switch device including a guide supporting member for guiding and supporting a key top. The guide supporting member includes a first link member and a second link member, both of which are formed of wire material. A pair of arms of the second link member are positioned inwardly of a pair of arms of the first link member, and the pair of arms of the first link member are made to cross the pair of arms of the second link member in order to make the first link member and the second link member rotatable at the cross section. The invention provides a thin key switch device whose guide supporting member has higher rigidity, and which can smoothly guide and support the key top.

6 Claims, 5 Drawing Sheets

KEY SWITCH USED IN A KEYBOARD

BACKGROUND OF THE INVENTION

1. Field of the Invention

The present invention relates to a key switch device suitable for use in a keyboard used as an input device of a personal computer, a word processor, or various other devices, and more particularly to a guide supporting mechanism for guiding and supporting a key top between a raised position and a lowered position.

2. Description of the Related Art

FIGS. 6 to 8 illustrate a conventional key switch device of the above-described type. The key switch device comprises a key top 41 molded from synthetic resin such as ABS resin; a holder member 52 disposed below the key top 41; a guide supporting member 44 for guiding and supporting the key top 41 between a raised position situated away from the holder member 52 and a lowered position situated close to the holder member 52; a switch member 57 mounted to the top surface of the holder member 52; and a rubber spring 58 disposed between the key top 41 and the switch member 57.

A character (not shown), such as a letter of the alphabet, is printed on the top surface of the key top 41. As shown in FIG. 6, rotary stopper sections 42 and sliding stopper sections 43 are integrally formed with the key top 41 so as to extend downward from the lower surface of the key top 41. A stopper hole 42*a* is formed in each rotary stopper section 42, while a stopper hole 43*a* is formed in each sliding stopper section 43.

The guide supporting member 44 comprises first and second link members 45 and 48 molded from synthetic resin material. As shown in FIG. 7, the first link member 45 is formed into a substantially U shape by a pair of arms 46 parallel to each other, and a connecting section 47 which integrally connects the pair of arms 46. A stopper pin 46*a* protrudes outward from one end of each arm 46, while a stopper pin 46*b* protrudes outward from the other end of each arm 46. A shaft hole 46*c* is formed in the center portion of each arm 46 so as to oppose each other.

The second link member 48 comprises a base section 49 including a circular hole 49*a*, and a pair of arms 50 formed consecutively at one end of the base section 49 so as to be parallel to each other. A stopper protrusion 50*a* protrudes from one end of each arm 50. A pair of outwardly protruding stopper pins 49*b* are formed on the opposite end of the base section 49. Outwardly protruding shafts 49*c* are provided on opposing ends of the base section 49.

As shown in FIG. 6, the first and second link members 45 and 48 are disposed so as to cross each other in an X-shaped configuration by positioning the base section 49 of the second link member 48 at the inner side of the pair of arms 46 of the first link member 45 and fitting the shafts 49*c* of the base section 49 into the corresponding shaft holes 46*c* in the arms 46. Crossing sections 51 formed by the shafts 49*c* and the shaft holes 46*c* allow the first and second link members 45 and 48 to rotate with respect to each other. The stopper protrusions 46*b* of the first link member 45 are slidably stopped in the corresponding stopper holes 43*a* in the key top 41, while the stopper pins 49*b* of the second link member 48 are rotatably stopped in the corresponding stopper holes 42*a* in the key top 41.

The holder member 52 is a metallic flat plate, and, as shown in FIG. 7, has a pair of slits 53*a* and 53*b* parallel to and opposing each other. When a flat-plate portion between the slits 53*a* and 53*b* is made to protrude thereabove from below, a sliding stopper section 54 including a stopper hole 54*a* is formed. In addition, two pairs of slits 55*a* and 55*b* are formed in the holder member 52 so as to be separated from the pair of slits 53*a* and 53*b* in a longitudinal direction thereof and so as to be parallel thereto. When a flat-plate portion between each pair of slits 55*a* and 55*b* is made to protrude thereabove from below, a rotary stopper section 56 including a stopper hole 56*a* is formed between its corresponding pair of slits 55*a* and 55*b*.

The stopper pins 46*a* of the first link member 45 are rotatably stopped by the stopper holes 56*a* in the corresponding rotary stopper sections 56, while the stopper protrusions 50*a* of the second link member 48 are slidably stopped by the stopper holes 54*a* in the sliding stopper section 54. The rotary stopper sections 56 at the holder member 52 are made to correspond with the sliding stopper sections 43 of the key top 41 by the first link member 45, while the sliding stopper section 54 of the holder 52 is made to correspond with the rotary stopper sections 42 at the key top 41 by the second link member 48.

The switch member 57 is formed by placing a top sheet, a spacer, and a bottom sheet upon each other in that order. The top sheet, spacer, and bottom sheet are not shown. Contact electrodes are formed on the bottom surface of the top sheet and the top surface of the bottom sheet, and are separated by a predetermined distance by the spacer so as to oppose each other. The bottom surface of the bottom sheet is brought into contact with the top surface of the holder member 52 in order to mount the switch member 57 to the holder member 52 with a suitable means, such as an adhesive.

The rubber spring 58 is formed of a rubber material and has a reversed conical shape. As shown in FIG. 6, it has an annular bottom section 58*a* which supports a top section 58*c* through a thin resilient wall 58*b*, and an actuating protrusion 58*d* formed on the lower surface of the top section 58*c*. The rubber spring 58 is disposed between the key top 41 and the switch member 57 by affixing the annular bottom section 58*a* to the top sheet of the switch member 57; is in contact with the bottom surface of the key top 41 as a result of inserting the top section 58*c* into the hole 49*a* in the second link member 48; and supports the top key 41 at a raised position situated away from the holder member 52 as a result of cooperating with the guide supporting member 44. The actuating protrusion 58*d* is opposed to the top surface of the top sheet in correspondence with the locations where the contact electrodes on the switch member 57 are formed.

In the key switch device having the above-described structure, when the operator presses the top surface of the key top 41, the key top 41 moves downward, causing the stopper protrusions 46*b* of the first link member 45 to slide in the stopper holes 43*a* in their corresponding stopper sections 43 in the direction of arrow G, and the stopper pins 49*b* of the second link member 48 to rotate in the stopper holes 42*a* in their corresponding rotary stopper sections 42. At the same time, the stopper pins 46*a* of the first link member 45 rotate in the stopper holes 56*a* in the rotary stopper sections 56, and the stopper protrusions 50*a* of the second link member 48 slide in the stopper holes 54*a* in the sliding stopper section 54 in the direction of arrow G.

This causes the first and second members 45 and 48 to be pushed downward as they rotate with the crossing sections 51 serving as a fulcrum, so that the key top 41 which is guided by the first and second link members 45 and 48 move downward along with the crossing sections 51. When the key top 41 moves downward, the rubber spring 58 is pushed downward by the key top 41, so that the resilient wall 58*b* is buckled, whereby a tactile feel is experienced. Immediately thereafter, as shown in FIG. 8, the key top 41 is positioned at a lowered position situated close to the holder member 52, and the actuating protrusion 58*d* presses and flexes the top sheet of the switch member 57. Therefore, the contact electrode on the top sheet comes into contact with the contact electrode on the lower sheet, thereby bringing these contact electrodes into electrical conduction, and turning on the switch device.

When, in this state, the pressing force on the top surface of the key top 41 is removed, the rubber spring 58 returns to its original reversed conical shape by the resilient force of the resilient wall 58b. Therefore, the key top 41 is pushed upward by the ascending top section 58*c*, the stopper protrusions 46*b* of the first link member 45 slide in the stopper holes 43*a* in the corresponding sliding stopper sections 43 in the direction of arrow H, and the stopper pins 49*b* of the second link member 48 rotate in the stopper holes 42*a* in the rotary stopper sections 42. At the same time, the stopper pins 46*a* of the first link member 45 rotate in the stopper holes 56*a* in the corresponding rotary stopper sections 56, and the stopper protrusions 50*a* of the second link member 48 slide in the stopper holes 54*a* in the stopper section 54 in the direction of arrow H.

This causes the first and second link members 45 and 48 to rotate with the crossing sections 51 as a fulcrum and rise upward, so that the key top 41 is guided by the first and second link members 45 and 48 and moves upward along with the crossing sections 51 to its original raised position. With the upward movement of the top section 58*c*, the top sheet of the switch member 57 flexed by the actuating protrusion 58*c* returns to its original shape due to its own flexibility, so that the contact electrode on the top sheet separates from the contact electrode on the bottom sheet, causing the contact electrodes to be brought out of electrical conduction, and, thus, the switch device to be switched off.

In the above-described conventional key switch device, the first link member 45 has portions with thicknesses X below the stopper protrusions 46*b*, and the second link member 48 has portions with thicknesses Y above the stopper protrusions 50*a*, so that the height of the conventional key switch device becomes larger by an amount corresponding to the thicknesses X and Y in a vertical direction. This in turn increases the thickness of the keyboard, itself, used in the key switch device. When an attempt is made to remove the portions of the first and second link members 45 and 48 with the thicknesses X and Y, and to reduce the size of the rubber spring 58 in a vertical direction in order to make the key switch device thinner by a corresponding amount, the first and second link members 45 and 48, which are molded from synthetic resin material, do not have sufficient rigidity, so that they get deformed and break due to the pressing force on the key top 41. Thus, the key top 41 cannot be smoothly guided and supported.

SUMMARY OF THE INVENTION

In view of the above-described problems in the conventional key switch device, it is an object of the present invention to provide a thin key switch device in which the rigidity of a guide supporting member is increased and a key top can be smoothly guided and supported.

To this end, according to one aspect of the present invention, there is provided a key switch device comprising:

a key top;

a holder member, disposed below the key top, having a stopper section formed thereat;

a guide supporting member for supporting the key top and guiding the key top between a raised position situated away from the holder member and a lowered position situated close to the holder member, the guide supporting member being stopped by the stopper section formed at the holder member; and a switch member for performing a switching operation as the key top is raised and lowered;

wherein the guide supporting member is a link member comprising a base end section stopped by the stopper section and an arm extending from the base end section, the link member being formed by bending a metallic material.

The guide supporting member with a high rigidity can be easily manufactured by bending operations, making it possible to provide a thin guide supporting member which can smoothly guide and support the key top.

According to another aspect of the present invention, there is provided a key switch device comprising:

a key top having a stopper section formed at a lower surface thereof;

a holder member, disposed below the key top, having a stopper section formed thereat in correspondence with the stopper section formed at the key top;

a guide supporting member for supporting the key top and guiding the key top between a raised position situated away from the holder member and a lowered position situated close to the holder member, the guide supporting member being connected to and stopped by the stopper section formed at the key top and the stopper section formed at the holder member; and a switch member for performing a switching operation as the key top is raised and lowered;

wherein the guide supporting member comprises first and second link members formed of a wire material, the first and second link members each including a base end section and a pair of parallel arms formed by bending both ends of the base end section corresponding thereto; and wherein the pair of arms of the second link member are positioned inwardly of the pair of arms of the first link member in order to make the pair of arms of the first link member and the pair of arms of the second link member cross each other at a crossing section, so that the first link member and the second link member are made rotatable at the crossing section.

Each arm of the pair of arms of the first link member may include a first engaging section which curves inward, and each arm of the pair of arms of the second link member may include a second engaging section which curves outward; and the crossing section may be formed by engaging the first engaging sections and their corresponding second engaging sections such that the second engaging sections are positioned outwardly of the first engaging sections.

The key switch device may be such that when the key top is pressed, the first and second link members are lowered as the first and second link members rotate, and, when the key top reaches the lowered position, key-top-sides of the pair of arms of the first link member and key-top-sides of the pair of arms of the second link member are flexed downward with the crossing section as a fulcrum in order to resiliently push the key top upward.

The key switch device may be such that when the key top moves downward as a result of being pressed, the first and second engaging sections slide with respect to each other in response to the rotation of the first and second link members, thereby causing the first engaging sections to flex the pair of arms of the second link member away from each other and outward, and causing the second engaging sections to flex the pair of arms of the first link member towards each other and inward; and when the key top is released, resilient restoring forces of the pair of arms of the first link member and resilient restoring forces of the pair of arms of the second link member cause the first and second link members to rotate and rise while the first and second engaging sections are made to slide with respect to each other in order to raise the key top.

The stopper section formed at the holder member may be disposed so as to oppose the lower surface of the key top; and each arm of the pair of arms of the first link member may include a section to be stopped formed by bending an end of the corresponding arm outward, the sections to be stopped being stopped by the stopper section formed at the holder member.

DESCRIPTION OF THE PREFERRED EMBODIMENT

Figure 1:
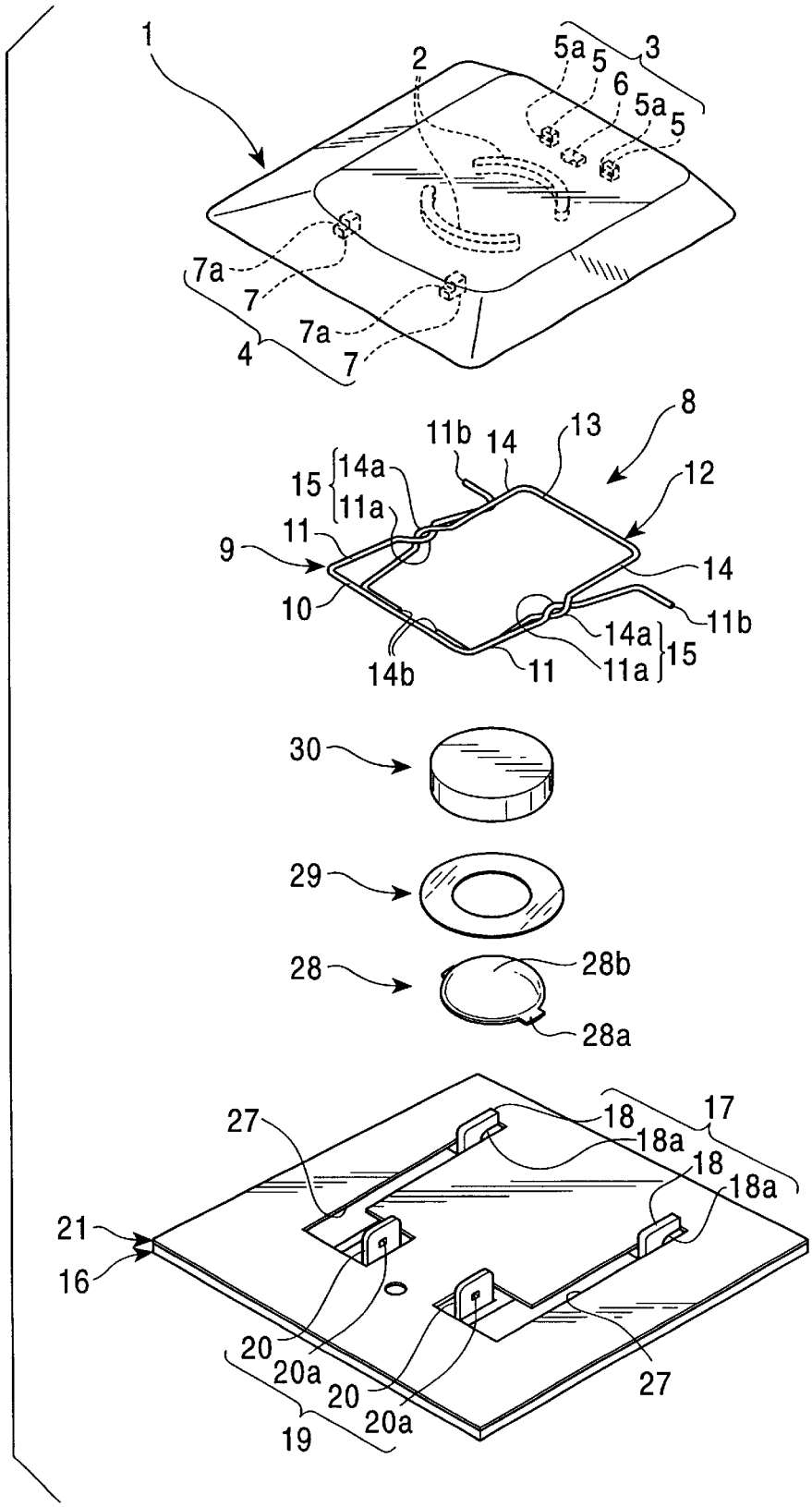
FIG. 1 is an exploded perspective view of a key switch device in accordance with the present invention.

Hereunder, a description of an embodiment of the key switch device in accordance with the present invention will be given with reference to FIGS. 1 to 5.

The key switch device includes a key top 1 molded from synthetic resin, such as ABS resin; a holder member 16 disposed below the key top 1; a guide supporting member 8 for guiding and supporting the key top 1 between a raised position situated away from the holder member 16 and a lowered position situated close to the holder member 16; a switch member 21 mounted to the top surface of the holder member 16; a click spring 28 bonded to the switch member 21; and a stem 30 for reversing the movement of the click spring 28.

A character (not shown), such as a letter of the alphabet, is printed on the top surface of the key top 1. As shown in FIG. 1, a pair of arch-shaped supporting protrusions 2, a rotary stopper section 3, and a sliding stopper section 4 are formed integrally with the key top 1 so as to extend downward from the lower surface of the key top 1. The rotary stopper section 3 includes two stopper protrusions 5, each of which has an arcuate groove 5*a*, and one stopper protrusion 6 disposed between the stopper protrusions 5. The sliding stopper section 4 includes a pair of L-shaped stopper protrusions 7, each of which has a stopper notch 7*a*.

The guide supporting member 8 comprises first and second link members 9 and 12, formed by bending a metallic wire spring material. As shown in FIG. 1, the first link member 9 includes a base end section 10 and a pair of parallel arms 11 formed by bending both ends of the base end section 10. Each arm 11 includes a first engaging section 11*a* curved inwardly from the center portion thereof; and a bent section 11*b* consecutively formed as a section to be stopped by bending outward an end portion of its corresponding arm 11.

The second link member 12 includes a base end section 13 and a pair of parallel arms 14 consecutively formed by bending both ends of the base end section 13. Each arm 14 has a second engaging section 14*a* curved outward from the center portion thereof, and a bent section 14*b* formed by bending inward an end portion of its corresponding arm 14.

Figure 3:
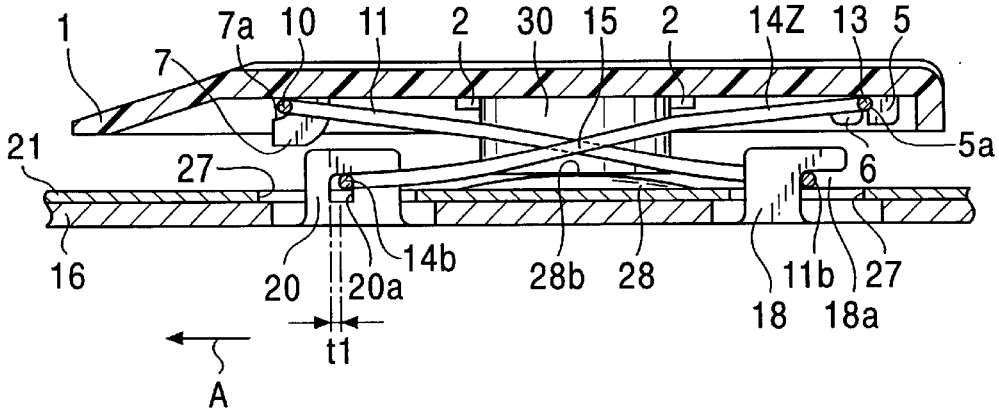
FIG. 3 is a sectional view of FIG. 2.

The first and second link members 9 and 12 are disposed so as to cross each other in an X-shaped configuration as viewed from a side surface as shown in FIG. 3 by positioning the pair of arms 14 of the second link member 12 inwardly of the pair of arms 11 of the first link member 9 so that the second engaging sections 14*a* are positioned outwardly of the first engaging sections 11*a*, and by engaging the first engaging sections 11*a* and their corresponding second engaging sections 14*a*. The first and second link members 9 and 12 are mutually rotatable at crossing sections 15 formed by their corresponding first and second engaging sections 11*a* and 14*a*. The base end section 10 of the first link member 9 is slidably stopped by stopping notches 7*a* at the key top 1, while the base end section 13 of the second link member 12 is rotatably fitted into a space defined by the stopper protrusions 5 and 6 at the key top 1 in order to be rotatably stopped by the grooves 5*a*.

The holder member 16 is a metallic flat plate, and, as shown in FIG. 1, a rotary stopper section 17 and a sliding stopper section 19 are integrally formed at the holder member 16 so as to extend upward by forming cuts and raising upward the portions where the cuts are formed. The rotary stopper section 17 comprises a pair of stopper protrusions 18, each of which has a stopper notch 18*a*. The sliding stopper section 19 comprises a pair of stopper protrusions 20, each of which has a stopper hole 20*a*.

Figure 2:
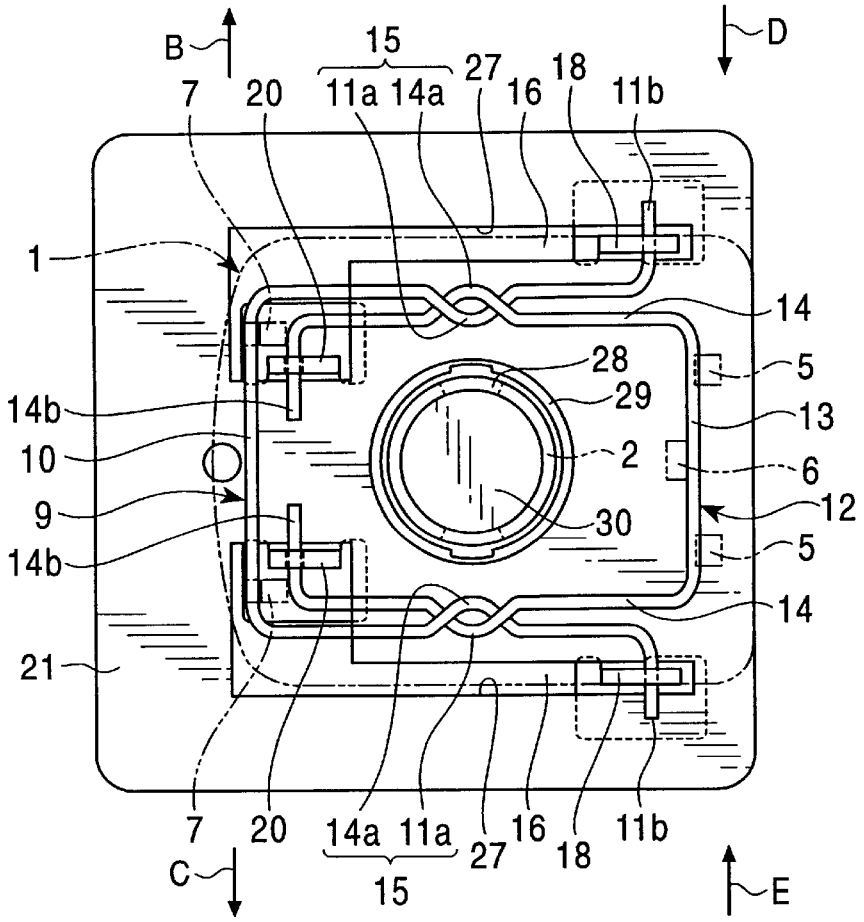
FIG. 2 is a plan view of the key switch device in accordance with the present invention when a key top thereof is at a raised position.

As shown in FIG. 2, the rotary stopper section 17 and the sliding stopper section 19 are disposed so as to oppose the lower surface of the key top 11 by positioning the pair of stopper protrusions 18 of the rotary stopper section 17 outwardly of the first link member 9, and by positioning the pair of stopper protrusions 20 of the sliding stopper section 19 inwardly of the second link member 12. As shown in FIG. 3, each bent section 11*b* of the first link member 9 is rotatably stopped by its corresponding stopper notch 18*a* in the rotary stopper section 17, while each bent section 14*b* of the second link member 12 is slidably stopped by its corresponding stopper hole 20*a* in the sliding stopper section 19. As a result, the first and second link members 9 and 12 support the key top 1 at the raised position situated away from the holder member 16; the first link member 9 causes the rotary stopper section 17 at the holder member 16 and the sliding stopper section 4 at the key top 1 to correspond to each other; and the second link member 12 causes the sliding stopper section 19 at the holder member 16 and the rotary stopper section 3 at the key top 1 to correspond to each other.

Figure 5:
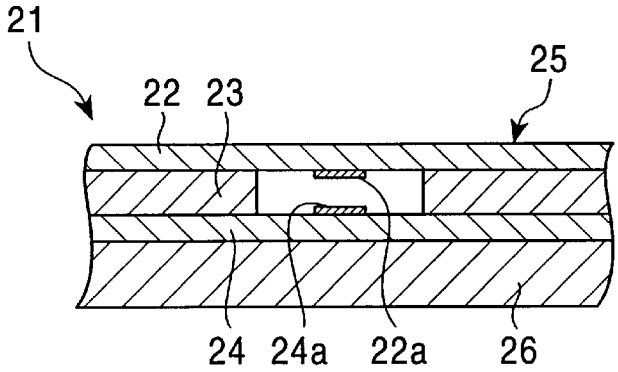
FIG. 5 is a sectional view of a switch member of the key switch device in accordance with the present invention.
Figure 6:
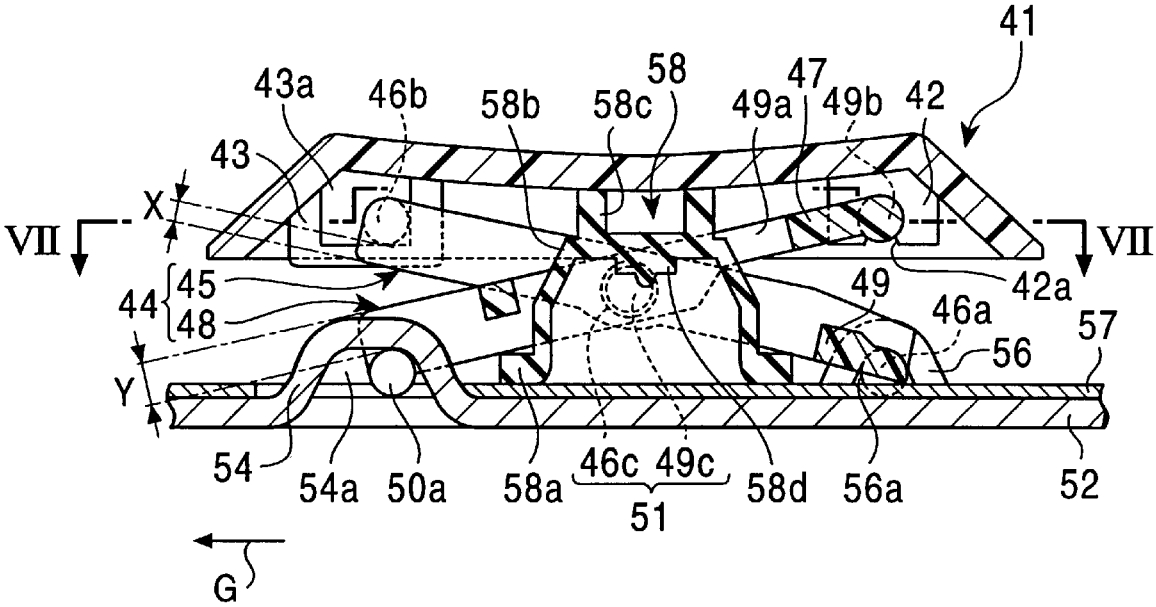
FIG. 6 PRIOR ART
FIG. 6 is a sectional view of a conventional key switch device when a key top thereof is at a raised position.
Figure 7:
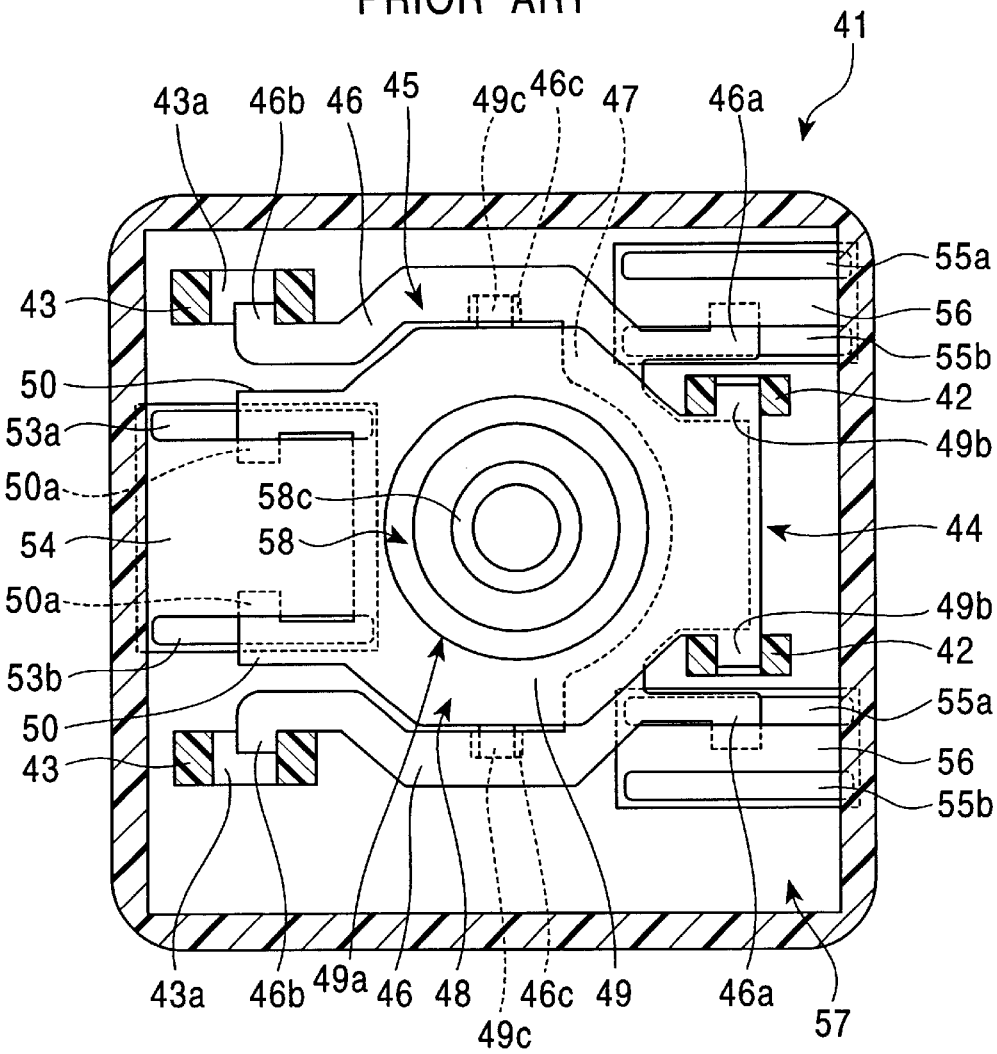
FIG. 7 PRIOR ART
FIG. 7 is a sectional view along line VII—VII of FIG. 6.
Figure 8:
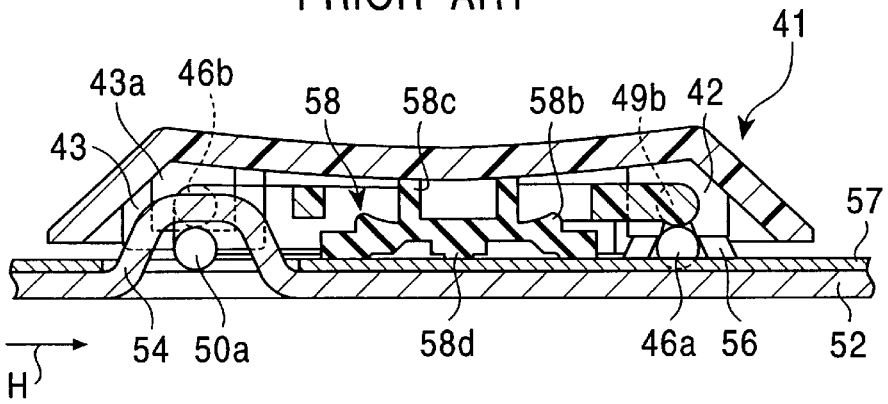
FIG. 8 PRIOR ART
FIG. 8 is a sectional view of the conventional key switch device when the key top thereof is at a lowered position.

As shown in FIG. 5, the switch member 21 is formed by bonding a switch section 25 to the top surface of a supporting plate 26, with the switch section 25 being formed by successively placing an upper sheet 22, a spacer 23, and a lower sheet 24 on top of each other in that order. Contact electrodes 22*a* and 24*a* are formed on the bottom surface of the upper sheet 22 and the top surface of the lower sheet 24, respectively. The contact electrodes 22*a* and 24*a* which are separated by a predetermined distance by the space 23 are disposed so as to oppose each other. As shown in FIG. 1, the switch member 21 is mounted to the holder member 16 with a suitable means such as an adhesive as a result of inserting the rotary stopper section 17 and the sliding stopper section 19 into a pair of L-shaped notches 27 and bringing the bottom surface of the supporting plate 26 into contact with the top surface of the holder member 16.

The click spring 28 is formed by forming a metallic, such as a stainless, thin plate into the shape of a dome, and includes a flange 28*a* integrally formed at the peripheral edge thereof. The click spring 28 is disposed between the key top 1 and the switch member 21 as a result of bonding the flange 28*a* to the top surface of the upper sheet 22 of the switch member 21 with a transparent ring tape 29. A top section 28*b* is disposed opposite to the top surface of the upper sheet 22 in correspondence with the locations where the contact electrodes 22*a* and 24*a* on the switch member 21 are formed.

The stem 30 is formed by forming a resilient material, such as rubber, into a cylindrical shape. The top portion thereof is supported at the lower surface of the key top 1 as a result of fitting it between the pair of supporting protrusions 2 at the key top 1. The bottom surface of the stem 30 is brought into contact with the top section 28*b* of the click spring 28, and, causes the click spring 28 to be in a slightly pressed state when the key top 1 is disposed at the raised position.

A description of the method of assembling the key switch device having the above-described structure will be given. When from its base-end-section-10 side the first link member 9 is inserted between the second engaging sections 14*a* of the second link member 12, the base end section 10 bumps into the second engaging sections 14*a*. From this bumped state, when the first link member 9 is pushed further, the pair of arms 14 of the second link member 12 are flexed outward. When the first engaging sections 11*a* of the first link member 9 are positioned at their corresponding engaging sections 14*a* of the second link member 12, the pair of arms 14 of the second link member 12 return to their original shapes, and the first and second engaging sections 11*a* and 14*a* engage each other, whereby the first link member 9 is secured to the second link member 12.

The pair of notches 27 in the switch member 21 are made to correspond to the rotary stopper section 17 and the sliding stopper section 19 at the holder member 16, and the switch member 21 is placed on the top surface of the holder member 16 in order to affix it thereto with an adhesive or other suitable means. Then, with the top section 28*b* of the click spring 28 being disposed in correspondence with the locations of the contact electrodes 22*a* and 24*a* on the switch member 21, the click spring 29 is affixed to the switch member 21 with ring tape 29. After the bonding, while slightly pushing end sides of the arms 14 of the second link member 12 away from each other and outward, the bent sections 14*b* of the corresponding arms 14 are inserted into the corresponding stopper holes 20*a* in the sliding stopper section 19 at the holder member 16 in order to connect and stop the second link member 12 to and by the sliding stopper section 19 at the holder member 16. Thereafter, while flexing end sides of the arms 11 of the first link member 9 slightly inward, the bent sections 11*b* thereof are inserted into the corresponding stopper notches 18*a* in the rotary stopper section 17 at the holder member 16 in order to connect and stop them to and by the rotary stopper section 17 at the holder member 16.

Next, the top portion of the stem 30 is fitted between the pair of supporting protrusions 2 at the key top 1 in order to support it by the key top 1, after which the base end section 10 of the first link member 9 is fitted to the stopper notches 7*a* in the sliding stopper section 4 in order to connect and stop the first link member 9 to and by the sliding stopper section 4 at the key top 1. From this state, when the key top 1 is pushed downward, the base end section 13 of the second link member 12 is fitted into the stopper protrusions 5 and 6 disposed at the key top 1 in order to be stopped by the grooves 5*a*, whereby the second link member 12 is connected to and stopped by the rotary stopper section 3 disposed at the key top 1.

After the above-described operations have been performed, the assembly of the key switch device is completed. After the assembly, the pair of arms 14 of the second link member 12 are positioned inwardly of the pair of arms 11 of the first link member 9, and the second engaging sections 14*a* engage the corresponding first engaging sections 11*a* outwardly of the first engaging sections 11*a*, whereby the first and second link members 9 and 12 cross each other in an X-shaped configuration as viewed from a side surface thereof. In this way, the key top 1 is supported at the raised position situated away from the holder member 16. In addition, as shown in FIG. 3, the bottom surface of the stem 30 is in contact with the top section 28*b* of the click spring 28, with a clearance t1 being formed between the stopper hole 20*a* in each sliding stopper section 19 of the holder 16 and its corresponding bent section 14*b* of the second link member 12.

In the key switch device having the above-described structure and assembled in the above-described way, when the operator presses the top surface of the key top 1, the key top 1 moves downward, causing the base end section 10 of the first link member 9 to slide in the stopper notches 7*a* in the sliding stopper section 4 in the direction of arrow A, and the base end section 13 of the second link member 12 to rotate in the grooves 5*a* in the rotary stopper section 3. At the same time, the bent sections 11*b* of the first link member 9 rotate in the corresponding stopper notches 18*a* in the rotary stopper section 17, and the bent sections 14*b* of the second link member 12 slide in the stopper holes 20*a* in the first sliding stopper sections 19 in the direction of arrow A.

This causes the first and second link members 9 and 12 to be lowered as they rotate with the crossing sections 15 as fulcrum, causing the key top 1 to be guided by the first and second link members 9 and 12 and to be lowered parallel to the holder member 16 along with the crossing sections 15. By sliding the first and second engaging sections 11*a* and 14*a* with respect to each other in response to the rotation of the first and second link members 9 and 12 when the key top 1 is lowered, the first engaging sections 11*a* flex the pair of arms 14 of the second member 12 integrally with the bent sections 14*b* so that they are flexed away from each other and outward (that is, in the directions of arrows B and C), and the second engaging sections 14*a* flex the arms 11 of the first link member 9 integrally with the bent sections 11*b* of the arms 11 so that they are flexed towards each other and inward (that is, in the directions of arrows D and E). Here, the first link member 9 remains connected to and stopped by the rotary stopper section 17 formed at the holder member 16, and the second link member 12 remains connected to and stopped by the sliding stopper section 19 formed at the holder member 16.

Figure 4:
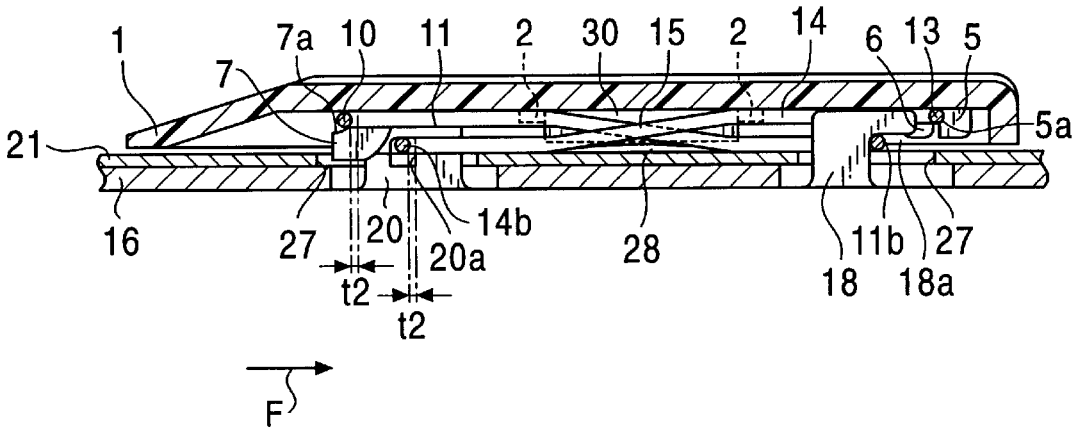
FIG. 4 is a sectional view of the key switch device in accordance with the present invention when the key top thereof is at a lowered position.

The stem 30 pushes in the top section 28*b* of the click spring 28 while it is pressed so as to be deformed by the key top 1, causing the click spring 28 to reverse its movement, whereby a tactile feel is experienced. Immediately thereafter, as shown in FIG. 4, the key top 1 is disposed at the lowered position situated close to the holder member 16, so that the key-top-1 sides (that is, the base-end-section-10 side and the base-end-section-13 side) of the pair of arms 11 and the pair of arms 14 are slightly flexed downward with the corresponding crossing sections 15 as a fulcrum, causing the top section 28*b* of the click spring 28 whose movement has been reversed to press the upper sheet 22 of the switch member 21 in order to flex it. Therefore, the contact electrode 22*a* on the upper sheet 22 comes into contact with the contact electrode 24*a* on the lower sheet 24 in order to bring the contact electrodes 22*a* and 24*a* into electrical conduction, whereby the switch device is turned on. At this time, a clearance t2 is formed between the base end section 10 of the first link member 9 and each stopper notch 7*a* in the sliding stopper section 4, and, similarly, a clearance t2 is formed between each bent section 14*b* of the second link member 12 and its corresponding stopper hole 20*a* in the sliding stopper section 19.

When the pushing force on the top surface of the key top 1 is removed, the pair of arms 11 of the first link member 9 and the pair of arms 14 of the second link member 12 return to their original shapes due to their own resilient restoring forces. Therefore, the key-top-1-sides (or the base-end-section-10 side and the base-end-section-13 side) of the pairs of arms 11 and 14 resiliently move upward with the crossing sections 15 as a fulcrum. Due to the resilient restoring forces, the first and second link members 9 and 12, with the crossing sections 15 as a fulcrum, rotate and rise while the first and second engaging sections 11*a* and 14*a* slide with respect to each other. This causes the base end section 10 of the first link member 9 to slide in the stopper notches 7*a* in the sliding stopper section 4 in the direction of arrow F, and the base end section 13 of the second link member 12 to rotate in the grooves 5*a* in the rotary stopper section 3. At the same time, this causes the bent sections 11*b* of the first link member 9 to rotate in the corresponding stopper notches 18*a* in the rotary stopper section 17, and the bent sections 14*b* of the second link member 12 to slide in the corresponding stopper holes 20*a* in the sliding stopper section 19 in the direction of arrow F.

As a result, the key top 1 is resiliently pushed upward and guided by the first and second link members 9 and 12, which, along with the crossing sections 15, rise, whereby the key top 1 returns to its original raised position. With the rising of the key top 1, the stem 30 and the click spring 28 are resiliently restored to their original states, so that the flexibility of the upper sheet 22 of the switch member 21 no longer allows the click spring 28 to flex the upper sheet 22 of the switch member 21. This causes the contact electrode 22*a* on the upper sheet 22 to separate from and to be brought out of electrical conduction with the contact electrode 24*a* on the lower sheet 24, whereby the switch is turned off. At this time, the resilient restoring forces of the stem 30 and the click spring 28 act on the key top 1 in order to assist the upward movement of the key top 1.

Although in the embodiment a structure in which the switch member 21 using the stem 30 and the click spring 28 performs a switching operation as the key top 1 is raised and lowered is described, the present invention is not limited thereto. A structure in which the switch member 21 is pressed directly by the supporting protrusions 2 as a result of changing the forms and positions of the supporting protrusions 2 disposed at the key top 1 may also be used. In this case, the stem 30 and click spring 28 are not required, making it possible to reduce the number of parts of the key switch device.

When the arms 11 of the first link member 9 are formed so that ends thereof are disposed slightly outward and away from each other, and when the arms 14 of the second link member 12 are formed so that ends thereof are disposed slightly inward and towards each other, play and shaking can be eliminated.

As can be understood from the foregoing description of the embodiment, the present invention provides the following advantages.

There is provided a key switch device comprising: a key top having a stopper section formed at a lower surface thereof; a holder member, disposed below the key top, having a stopper section formed thereat in correspondence with the stopper section formed at the key top; a guide supporting member for supporting the key top and guiding the key top between a raised position situated away from the holder member and a lowered position situated close to the holder member, the guide supporting member being connected to and stopped by the stopper section formed at the key top and the stopper section formed at the holder member; and a switch member for performing a switching operation as the key top is raised and lowered; wherein the guide supporting member comprises first and second link members formed of a wire material, the first and second link members each including a base end section and a pair of parallel arms formed by bending both ends of the base end section corresponding thereto; and wherein the pair of arms of the second link member are positioned inwardly of the pair of arms of the first link member in order to make the pair of arms of the first link member and the pair of arms of the second link member cross each other at a crossing section, so that the first link member and the second link member are made rotatable at the crossing section. Therefore, it is possible to provide a thin key switch device whose guide supporting member has higher rigidity and which can smoothly guide and support the key top.

Each arm of the pair of arms of the first link member may include a first engaging section which curves inward, and each arm of the pair of arms of the second link member may include a second engaging section which curves outward; and the crossing section may be formed by engaging the first engaging sections and their corresponding second engaging sections such that the second engaging sections are positioned outwardly of the first engaging sections. Therefore, it is possible to provide a lower cost key switch device which makes it possible to simplify the structure and assembly of the crossing section.

The key switch device may be such that when the key top is pressed, the first and second link members are lowered as the first and second link members rotate, and, when the key top reaches the lowered position, key-top-sides of the pair of arms of the first link member and key-top-sides of the pair of arms of the second link member are flexed downward with the crossing section as a fulcrum in order to resiliently push the key top upward. Therefore, it is possible to apply a restoring force to the key top to restore it to the raised position without using a special component part.

The key switch device may be such that when the key top moves downward as a result of being pressed, the first and second engaging sections slide with respect to each other in response to the rotation of the first and second link members, thereby causing the first engaging sections to flex the pair of arms of the second link member away from each other and outward, and causing the second engaging sections to flex the pair of arms of the first link member towards each other and inward; and when the key top is released, resilient restoring forces of the pair of arms of the first link member and resilient restoring forces of the pair of arms of the second link member cause the first and second link members to rotate and rise while the first and second engaging sections are made to slide with respect to each other in order to raise the key top. Therefore, it is possible to reliably restore the key top to the raised position without using a rubber spring which is required in the conventional technology.

The stopper section formed at the holder member may be disposed so as to oppose the lower surface of the key top; and each arm of the pair of arms of the first link member may include a section to be stopped formed by bending an end of the corresponding arm outward, the sections to be stopped being stopped by the stopper section formed at the holder member. Therefore, the opposing areas of the lower surface of the key top and the holder member and the areas where the sections to be stopped are operated as a result of flexing the pair of arms of the first link member can be made to overlap each other. Consequently, the key switch device can be reduced in size.

What is claimed is:

1. A key switch device comprising:

a key top;

a holder member, disposed below the key top, having a stopper section formed thereat;

a guide supporting member for supporting the key top and guiding the key top between a raised position situated away from the holder member and a lowered position situated close to the holder member, the guide supporting member being stopped by the stopper section formed at the holder member;

a switch member for performing a switching operation as the key top is raised and lowered;

wherein the guide supporting member is a link member comprising a base end section stopped by the stopper section and an arm extending from the base end section, the link member being formed by bending a metallic material;

wherein the guide supporting member comprises first and second link members formed of a wire material, the first and second link members each including a base end section and a pair of parallel arms formed by bending both ends of the base end section corresponding thereto; and wherein the pair of arms of the second link member are positioned inwardly of the pair of arms of the first link member in order to make the pair of arms of the first link member and the pair of arms of the second link member cross each other at a crossing section, so that the first link member and the second link member are made rotatable at the crossing section.

2. A key switch device comprising:

a key top having a stopper section formed at a lower surface thereof;

a holder member, disposed below the key top, having a stopper section formed thereat in correspondence with the stopper section formed at the key top;

a guide supporting member for supporting the key top and guiding the key top between a raised position situated away from the holder member and a lowered position situated close to the holder member, the guide supporting member being connected to and stopped by the stopper section formed at the key top and the stopper section formed at the holder member; and a switch member for performing a switching operation as the key top is raised and lowered;

wherein the guide supporting member comprises first and second link members formed of a wire material, the first and second link members each including a base end section and a pair of parallel arms formed by bending both ends of the base end section corresponding thereto; and wherein the pair of arms of the second link member are positioned inwardly of the pair of arms of the first link member in order to make the pair of arms of the first link member and the pair of arms of the second link member cross each other at a crossing section, so that the first link member and the second link member are made rotatable at the crossing section.

3. A key switch device according to claim 2, wherein each arm of the pair of arms of the first link member includes a first engaging section which curves inward, and each arm of the pair of arms of the second link member includes a second engaging section which curves outward; and wherein the crossing section is formed by engaging the first engaging sections and their corresponding second engaging sections such that the second engaging sections are positioned outwardly of the first engaging sections.

4. A key switch device according to claim 2, wherein, when the key top is pressed, the first and second link members are lowered as the first and second link members rotate, and, when the key top reaches the lowered position, key-top-sides of the pair of arms of the first link member and key-top-sides of the pair of arms of the second link member are flexed downward with the crossing section as a fulcrum in order to resiliently push the key top upward.

5. A key switch device according to claim 3, wherein when the key top moves downward as a result of being pressed, the first and second engaging sections slide with respect to each other in response to the rotation of the first and second link members, thereby causing the first engaging sections to flex the pair of arms of the second link member away from each other and outward, and causing the second engaging sections to flex the pair of arms of the first link member towards each other and inward; and wherein, when the key top is released, resilient restoring forces of the pair of arms of the first link member and resilient restoring forces of the pair of arms of the second link member cause the first and second link members to rotate and rise while the first and second engaging sections are made to slide with respect to each other to raise the key top.

6. A key switch device according to claim 2, wherein the stopper section formed at the holder member is disposed so as to oppose the lower surface of the key top; and wherein each arm of the pair of arms of the first link member includes a section to be stopped formed by bending an end of the corresponding arm outward, the sections to be stopped being stopped by the stopper section formed at the holder member.

* * * * *